US010159371B2

(12) United States Patent
Windows, Jr.

(10) Patent No.: US 10,159,371 B2
(45) Date of Patent: Dec. 25, 2018

(54) INTEGRATED BUTTONING ASSIST AND UNBUTTONING ASSIST TOOL

(71) Applicant: Howard Windows, Jr., Russellton, PA (US)

(72) Inventor: Howard Windows, Jr., Russellton, PA (US)

( * ) Notice: Subject to any disclaimer, the term of this patent is extended or adjusted under 35 U.S.C. 154(b) by 0 days.

(21) Appl. No.: 15/616,591

(22) Filed: Jun. 7, 2017

(65) Prior Publication Data

US 2017/0360232 A1 Dec. 21, 2017

Related U.S. Application Data

(60) Provisional application No. 62/350,946, filed on Jun. 16, 2016.

(51) Int. Cl.
*A47G 25/92* (2006.01)
*A47G 25/90* (2006.01)

(52) U.S. Cl.
CPC ..... *A47G 25/92* (2013.01); *A47G 25/902* (2013.01); *Y10T 24/17* (2015.01)

(58) Field of Classification Search
CPC ..... Y10T 24/17; Y10T 24/2586; A47G 25/92; A47G 25/902
USPC ..... D2/643; D11/209; 294/3.6
See application file for complete search history.

(56) References Cited

U.S. PATENT DOCUMENTS 68,361 A 9/1867 Goldthwait
208,858 A 10/1878 Smith
246,198 A * 8/1881 Pyles ..... A47G 25/92 24/40
322,284 A 7/1885 Havell
361,151 A 4/1887 Fallis
438,034 A 10/1890 Tobey
438,751 A 10/1890 Hodge
511,481 A * 12/1893 Williams ..... A47G 25/92 24/40
639,442 A 12/1899 Salisbury
3,683,459 A * 8/1972 Johansen ..... A44B 3/00 24/40
D240,669 S 7/1976 Pifer
4,942,646 A 7/1990 Sebastian
5,347,688 A 9/1994 Ross
D384,186 S 9/1997 Teaman
5,732,447 A 3/1998 Nolen et al.
D401,389 S 11/1998 Taylor et al.
6,032,996 A * 3/2000 Kogen ..... A47G 25/901 24/40
D702,592 S 4/2014 Aceto
(Continued)

*Primary Examiner* — Robert Sandy
*Assistant Examiner* — Michael S Lee
(74) *Attorney, Agent, or Firm* — Blynn L. Shideler; Krisanne Shideler; BLK Law Group

(57) ABSTRACT

An integrated buttoning assist and unbuttoning assist device includes a handle member; a button assist tool coupled to one end of the handle member and including a wire loop extending from one end of the handle; and an unbuttoning assist tool coupled to an opposed end of the handle member and including a spanner extending from the opposed end of the handle member, the spanner including a fixed lower jaw member having a pair of button engaging tangs separated by a slot which is configured to receive the threads or eye of a button therein, and the spanner including a fixed button engaging upper jaw member.

4 Claims, 1 Drawing Sheet

(56) References Cited

U.S. PATENT DOCUMENTS

| | | | | |
|---|---|---|---|---|
| 2007/0119018 | A1* | 5/2007 | Snyder | A47G 25/92 16/8 |
| 2015/0245725 | A1* | 9/2015 | Benjamin | A47G 25/902 294/3.6 |

* cited by examiner

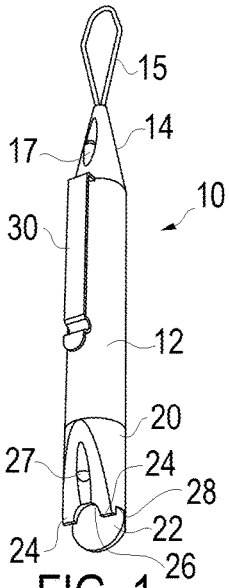
FIG. 1
FIG. 2
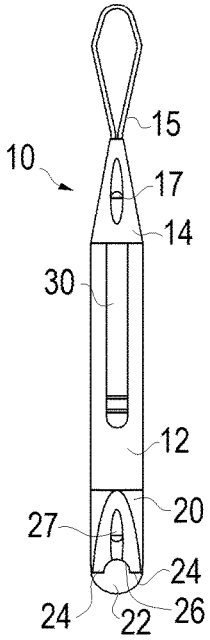
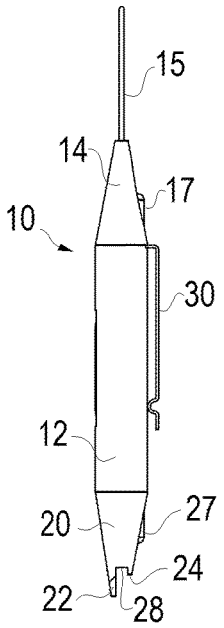
FIG. 3
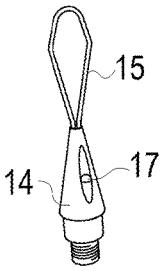
FIG. 4
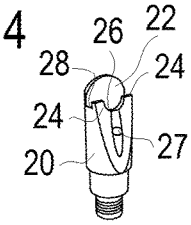
FIG. 5
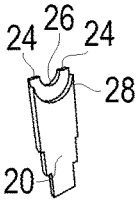
FIG. 6
FIG. 7
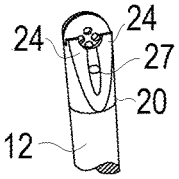
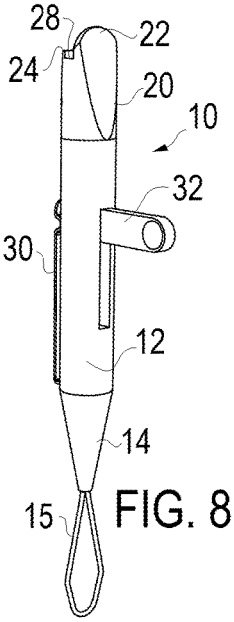
FIG. 8
FIG. 9
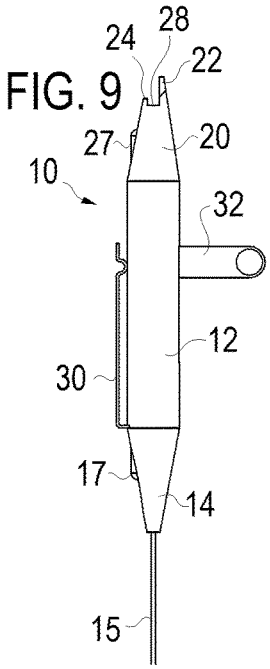

INTEGRATED BUTTONING ASSIST AND UNBUTTONING ASSIST TOOL

RELATED APPLICATIONS

This application claims the benefit of U.S. Provisional Patent Application Ser. No. 62/350,946 filed Jun. 16, 2016 entitled "Integrated Buttoning Assist and Unbuttoning Assist Tool" which application is incorporated herein by reference in its entirety.

BACKGROUND INFORMATION

1. Field of the Invention

The present invention relates to an integrated tool for assisting individuals with buttoning and unbuttoning shirts and the like.

2. Background of the Invention

The patent literature has a number of buttoning assist devices, many of these specifically for buttoning the shoes and corsets of the day. Shoes and corsets represented a certain level of difficulty in buttoning, and unbuttoning, despite the level of dexterity of the person attending the task. Additionally the buttoning assist devices have been proposed for those with limited dexterity due to age, arthritis, amputation, illness, medical condition, and the like. It is worth noting the incredible loss of independence that some people experience when they can no longer button and unbutton clothing, as they can no longer dress themselves. The significance of this act is sometimes lost on family and other caregivers who are more than willing to fill in for what they deem an unimportant task. Similarly the importance of someone regaining this ability, with a tool or otherwise, is often quite significant to the individual and easy to overlook by caregivers.

In the patent literature see for example one early patent is the 1867 U.S. Pat. No. 68,361 for "Improvement in Buttoners for Shoes" which consists of a loop of wire (or sheet metal) secured at one end of a handle. The loop is placed through the button hole and around the button then drawn back through the buttonhole to pull the button through the button hole. Due to the 150 years of patenting in this field, and to the mix of design and utility patents, the patents will be listed herein with the year as well to minimize confusion. See other loop based buttoner in relatively recent 2014 U.S. Design Pat. No. D702,592 for a buttoner; the 1997 U.S. Design Pat. No. D384,186; the 1990 U.S. Pat. No. 4,942,646 for a shirt collar buttoning device; the 1976 U.S. Design Pat. No. D240,669; the 1899 U.S. Pat. No. 639,442 for a collar buttoner; the 1890 U.S. Pat. No. 438,751 for a buttoning assist tool; also in 1890 U.S. Pat. No. 438,034 for a shoe and glove buttoner; the 1885 U.S. Pat. No. 322,284 for a shoe and glove buttoner; and the 1878 U.S. Pat. No. 208,858.

Some patents address the need for a tool with more utility than merely buttoning. A 1994 U.S. Pat. No. 5,347,688 discloses an integrated buttoning device which combines a loop based buttoning device for jeans and zipper puller. See also the integrated buttoning device and zipper puller of 1998 U.S. Pat. No. D401,389.

The 1887 U.S. Pat. No. 361,151 addresses the need for both buttoning and unbuttoning shoes and provides an integrated tool with a shoe button hook on one end and a shoe unbuttoner with shoe engaging bowl on the other end of the tool. This device is not applicable to conventional shirt buttons.

The 1998 U.S. Pat. No. 5,732,447 involves an integrated "button hooker and unhooker that can also be used to zip and unzip zippers." The patent noted that conventional loop type button hookers are not capable of also unbuttoning clothing and that individuals with limited hand dexterity may desire the freedom to both button and unbutton clothing without requiring another individual's help. The device has an insertion portion at one end for sliding into a buttonhole, a buttoner portion at the other end in the form of a hook and an unbuttoner portion there between.

All of the above patents are incorporated herein by reference and give about a 150 year retrospective of the state of the art in this field. The utility of buttoning devices is well established in the field, however there remains a need for assisting the buttoning and unbuttoning of conventional modern shirts and similar clothing for those with limited dexterity due to age, arthritis, amputation, illness, medical condition, and the like.

SUMMARY OF THE INVENTION

One aspect of the present invention provides an Integrated Buttoning Assist and Unbuttoning Assist Tool. An integrated buttoning assist and unbuttoning assist device according to the present invention includes a handle member; a button assist tool coupled to one end of the handle member and including a wire loop extending from one end of the handle; and an unbuttoning assist tool coupled to an opposed end of the handle member and including a spanner extending from the opposed end of the handle member, the spanner including a fixed lower jaw member having a pair of button engaging tangs separated by a slot which is configured to receive the threads or eye of a button therein, and the spanner including a fixed button engaging upper jaw member.

These and other advantages of the present invention will be clarified in the brief description of the preferred embodiment taken together with the drawings in which like reference numerals represent like elements throughout.

BRIEF DESCRIPTION OF THE DRAWINGS

FIG. 1 is a perspective view of an integrated buttoning and unbuttoning tool according to a first embodiment of the present invention;

FIG. 2 is a side elevation view of the integrated buttoning and unbuttoning tool according to FIG. 1;

FIG. 3 is a side elevation view of the integrated buttoning and unbuttoning tool according to FIG. 1;

FIG. 4 is a perspective view of the buttoning tool of the integrated buttoning and unbuttoning tool according to FIG. 1;

FIG. 5 is a perspective view of the unbuttoning tool of the integrated buttoning and unbuttoning tool according to FIG. 1;

FIG. 6 is a sectional view of the unbuttoning tool of the integrated buttoning and unbuttoning tool according to FIG. 1;

FIG. 7 is a perspective view of the unbuttoning tool of the integrated buttoning and unbuttoning tool according to FIG. 1 engaging a button;

FIG. 8 is a perspective view of an integrated buttoning, unbuttoning and zipper pulling tool according to another embodiment of the present invention; and FIG. 9 is a perspective view of an integrated buttoning, unbuttoning and zipper pulling tool according to another embodiment of the present invention.

DESCRIPTION OF THE PREFERRED EMBODIMENTS

The present invention can be broadly described as an integrated buttoning assist and unbuttoning assist device or tool 10 as shown in the figures which includes a handle member 12; a button assist tool 14 coupled to one end of the handle member 12 and including a wire loop 15 extending from one end of the handle member 12; and an unbuttoning assist tool 20 coupled to an opposed end of the handle member 12 and including a spanner extending from the opposed end of the handle member 12, the spanner including a fixed button engaging upper jaw member 22 and a fixed lower jaw member having a pair of button engaging tangs 24 separated by a slot 26 which is configured to receive the threads or eye of a button therein.

The handle member 12 may be formed easily of plastic, metal or other suitable material. An anodized aluminum tube structure forming handle 12 yields a very attractive device 10, with the attractive device 10 adding to the utility in that such factors increase the use and implementation of the device 10. The button assist tool 14 and the unbuttoning assist tool 20 may be formed as tool tips threaded into the handle member 12 as shown. An anodized aluminum tube forming the handle 12 allows for easy formation of durable threads. The threading of the button assist tool 14 and the unbuttoning assist tool 20 onto the handle 12 allows distinct sizes of these tools 14 and 20 to be formed, such as for women's buttons and men's buttons. In this manor the tools 14 and 20 may be changed in size by the user as needed.

Alternatively the handle member 12 and may be formed integral with the unbuttoning assist tool 20. The shape of the handle member 12 should be selected to give those needing the assistance of the device 10 something easy to grasp. A knurled gripping surface or finger grips may be included to assist operation. The handle may include a clip 30 to secure the device to a user's pocket or belt as desired.

As noted above and shown in the figures, the button assist tool 14 is coupled to one end of the handle member 12 and includes a wire loop 15 extending from one end of the handle member 12. The wire loop 15 includes a button hole expanding portion adjacent the handle member 12 and the wire loop 15 includes a button holding portion adjacent the button hole expanding portion. Further as shown, the wire loop 15 includes a forward distal portion adjacent the button holding portion and narrower than the button holding portion. The button assist tool 14 may include a press activated LED light 17 to assist the user in vision for ease of operation.

In operation of the button assist tool 14, the user holds the device 10 by the handle member 12 and inserts the narrow forward distal portion of wire loop 15 through a button hole and places the wire loop 15 of the tool 14 around the button. The user pulls the handle member 12 to pull the held button through the button hole. The button hole expanding portion of the loop 15 assists in this by expanding the button hole prior to the button being pulled through. Once the button is pulled through the button is moved out of the wire loop 15 of the tool 14, and the process may be repeated.

The unbuttoning assist tool 20 is coupled to an opposed end of the handle member 12 from the tool 14 and may be formed as a separate screw-on tip as shown or, alternatively, as integral with the handle member 12, such as by injection molding of a thermoplastic resin. The tool 20 is in the form of a spanner extending from the opposed end of the handle member 12 as the tool 14. The spanner including a fixed button engaging upper jaw member 22 spaced from a fixed lower jaw member (tangs 26) by a button receiving gap 28. The lower jaw member of the spanner has a pair of button engaging tangs 24 separated by a slot 26 which is configured to receive the threads or eye of a button therein. The terms Lower and Upper are arbitrary in this context and used merely to distinguish the elements.

As shown, the slot 26 is rounded and increases in width in a direction extending along the slot 26 away from the coupling of the spanner of tool 20 to the handle member 12. As shown, the slot 26 and the button engaging tangs 24 extend along a centerline of the handle member 12. The button engaging tangs 24 include rounded edges and at least the apex of the slot 26 is rounded to minimize the likelihood of damage to the button threads. The unbutton assist tool 20 may include a press activated LED light 27 to assist the user in vision for ease of operation In operation of the unbuttoning assist tool 20, the user holds the device 10 by the handle member 12 and inserts the subject buttoned button within the gap 28 of the spanner. A lifting or pivoting of the handle member 12 allows the upper jaw member 22 to engage the button on an opposite side of a centerline of the button from a coupling of the upper jaw member 22 and the lower jaw member, to allow the user to easily control and push the button back through the associated button hole. A distance between the upper jaw and the lower jaw in a button receiving portion defined by gap 28 of the unbuttoning assist tool 20 is greater than a thickness of the buttons for which the tool 20 may be used.

FIGS. 8-9 illustrate an integrated buttoning and unbuttoning device 10 according to a second embodiment of the present invention, with the device 10 including the same elements as described in FIGS. 1-7 above and further including a zipper puller 32 pivoted to the handle member 12.

The zipper puller 32 includes magnets 34, preferably rare earth magnets, which can couple the zipper puller with a zipper pull tab of magnetic material. In operation, the zipper puller 32 is pivoted by the user to the operative position shown in FIGS. 8-9. The user then engages magnets 34 of zipper puller 32 with the pull tab on the slider of the zipper to move the slider as desired. The user holds the handle member 12, which forms a T-handle with the extended puller 32, with the zipper puller 32 engaged with a pull tab via magnets 34, the zipper and advances the device 10 in the desired direction. The magnets 34 allow for ease of coupling and uncoupling the puller 32 to the zipper pull tab. If the zipper pull tab is not a magnetic material, then a small magnetic material can be coupled to the sipper pull. Magnetic coupling is believed to be much easier than attempting to thread a puller tool head through the eye of a pull tab.

Although the present invention has been described with particularity herein, the scope of the present invention is not limited to the specific embodiments disclosed. It will be apparent to those of ordinary skill in the art that various modifications may be made to the present invention without departing from the spirit and scope thereof. For example the array may be selected in length to provide a whole-scan-line channel storage option, which would not change the fundamentals of operation of the system or method of the invention.

What is claimed is:

1. An integrated buttoning assist and unbuttoning assist device comprising:

A) a tubular handle member;

B) a button assist tool coupled to one end of the handle member and including a wire loop extending from one end of the tubular handle member, wherein the wire loop includes a button hole expanding portion adjacent the tubular handle and a button holding portion adjacent the button hole expanding portion, wherein the wire loop button hole expanding portion adjacent the handle member includes straight portions of the wire extending away from each other in a direction extending away from the tubular handle, and wherein the wire loop button holding portion adjacent the button hole expanding portion includes straight portions of the wire extending toward each other in a direction extending away from the tubular handle, and wherein the button assist tool is threaded into the tubular handle, C) an unbuttoning assist tool coupled to an opposed end of the handle member and including a spanner extending from the opposed end of the handle member, the spanner including a fixed lower jaw member having a pair of button engaging tangs separated by a slot which is configured to receive the threads or eye of a button therein, and the spanner including a fixed button engaging upper jaw member.

2. The integrated buttoning assist and unbuttoning assist device according to claim 1 wherein the wire loop includes a forward distal portion adjacent the button holding portion and narrower than the button holding portion, and wherein the tubular handle is formed as an anodized aluminum handle.

3. The integrated buttoning assist and unbuttoning assist device according to claim 2 further including a zipper puller coupled to the handle between the ends thereof.

4. The integrated buttoning assist and unbuttoning assist device according to claim 3 wherein zipper puller is pivoted between a stored position and an operative position and includes magnets coupling the zipper puller to the zipper.

* * * * *